US006159035A

United States Patent [19]

Smith, III

[11] Patent Number: 6,159,035

[45] Date of Patent: Dec. 12, 2000

[54] CONNECTOR ASSEMBLY HAVING MEANS FOR PENETRATING THE INSULATION AND ESTABLISHING ELECTRICAL CONNECTION WITH THE WIRES

[75] Inventor: Lowell J. Smith, III, Rancho Palos Verdes, Calif.

[73] Assignee: Audio Components International, Inc., Rancho Palos Verdes, Calif.

[21] Appl. No.: 09/448,358

[22] Filed: Nov. 23, 1999

[51] Int. Cl.[7] ..... H01R 4/24; H01R 4/26; H01R 11/20

[52] U.S. Cl. ..... 439/391; 439/409; 439/410

[58] Field of Search ..... 439/391, 393, 439/396, 409, 410

[56] References Cited

U.S. PATENT DOCUMENTS

| | | | |
|---|---|---|---|
| 3,816,819 | 6/1974 | Judd | 339/99 R |
| 3,877,774 | 4/1975 | Dorrell | 339/99 |
| 3,976,351 | 8/1976 | Hopfe | 339/99 R |
| 4,157,208 | 6/1979 | Roberts et al. . | |
| 4,253,722 | 3/1981 | Fox, Jr. . | |
| 4,270,826 | 6/1981 | Narozny | 339/75 MP |
| 4,451,104 | 5/1984 | Hodgson et al. . | |
| 4,572,603 | 2/1986 | Weidler . | |
| 4,653,187 | 3/1987 | Sowinski . | |
| 4,793,823 | 12/1988 | Cozzens et al. | 439/409 |
| 4,957,452 | 9/1990 | Bolliger | 439/410 |
| 5,259,769 | 11/1993 | Cruise et al. . | |
| 5,704,801 | 1/1998 | Walker et al. | 439/417 |
| 5,746,626 | 5/1998 | Kwiat et al. . | |
| 5,807,133 | 9/1998 | Arnett . | |
| 5,975,938 | 11/1998 | Libby | 439/410 |

*Primary Examiner*—Lincoln Donovan
*Assistant Examiner*—Kyung S. Lee
*Attorney, Agent, or Firm*—Thomas I. Rozsa; Tony D. Chen; Jerry Fong

[57] ABSTRACT

A connector assembly for penetrating the insulation and establishing electrical connection with insulated electrical wires or conductors, thereby eliminating the need to strip the insulation away from the insulated wires, including a pair of matable housings, a pair of conductor guides, a pair of flexible piercing terminals and a pair of rotatable cams or levers, and which are all enclosed by the pair of matable housings. The unstriped insulated wires are respectively inserted into and positioned within the pair of conductor guides, where the cams are rotated inwardly such that the cams engage and squeeze the conductor guides to retain the insulated wires thereto. While the cams are being rotated, they also engage the piercing terminals such that knife ends pierce the insulated wires or conductors to establish electrical connection thereto.

20 Claims, 5 Drawing Sheets

CONNECTOR ASSEMBLY HAVING MEANS FOR PENETRATING THE INSULATION AND ESTABLISHING ELECTRICAL CONNECTION WITH THE WIRES

BACKGROUND OF THE INVENTION

1. Field of the Invention

The present invention generally relates to the field of connector assemblies. More particularly, the present invention relates to the field of connector assemblies having means for penetrating the insulation and establishing electrical connection with the insulated electrical wires.

2. Description of the Prior Art

Specifically, connectors are well known in the art. These prior art connectors are used for establishing electrical connection between electronic devices. While many prior art connectors are adequate in a number of applications, there is still a need for improvement. Most of the known termination methods have required some type of insulation striping or other preparation prior to making an electrical connection.

The following eight (8) prior art patents are found to be pertinent to the field of the present invention:

1. U.S. Pat. No. 4,157,208 issued to Roberts et al. on Jun. 5, 1979 for "Waterproof Splice Electrical Connector" (hereafter the "Roberts Patent");
2. U.S. Pat. No. 4,451,104 issued to Hodgson et al. on May 29, 1984 for "Apparatus For Splicing Electric Wires" (hereafter the "Hodgson Patent");
3. U.S. Pat. No. 4,253,722 issued to Fox, Jr. on Mar. 3, 1981 for "Insulation Pierce-Type Connector For Ribbon Cable" (hereafter the "Fox Patent");
4. U.S. Pat. No. 4,572,603 issued to Weidler on Feb. 25, 1986 for "Connector For Terminating Small Gauge Magnet Wire" (hereafter the "Weidler Patent");
5. U.S. Pat. No. 4,653,187 issued to Sowinski on Mar. 31, 1987 for "Connector Fabrication Method And Apparatus" (hereafter the "Sowinski Patent");
6. U.S. Pat. No. 5,259,769 issued to Cruise et al. on Nov. 9, 1993 for "Electrical Connector With Preloaded Spring-Like Terminal With Improved Wiping Action" (hereafter the "Cruise Patent");
7. U.S. Pat. No. 5,746,626 issued to Kwiat et al. on May 5, 1998 for "Electrical Connector Assembly" (hereafter the "Kwiat Patent"); and
8. U.S. Pat. No. 5,807,133 issued to Arnett on Sep. 15, 1998 for "Insulation Displacement Connector" (hereafter the "Arnett Patent").

The Roberts Patent discloses a waterproof splice electrical connector. The connector includes an outer casing which receives a cylindrical plug member. A circular plate-like contact terminal is mounted between the plug member and a base, and both are mounted within a third casing member. The terminal is free to rotate through a prescribed arc with respect to the plug member and the base. When the plug assembly is in turn mounted in the outer casing, the plug assembly is also rotatable through a similar prescribed arc relative to the outer casing. In the assembled configuration, the terminal is fixed relative to the outer casing. Two or more wires can then be spliced by inserting the wires into the plug assembly and imparting relative rotation between the outer casing and the plug assembly. During rotation, insulation piercing members on the terminal establish the electrical interconnection between the wires.

The Hodgson Patent discloses an apparatus for splicing electric wires. It comprises a housing which has two channels with each channel extending through the housing from an entrance opening to an exit opening. The housing further comprises a partition located between the channels, a ramped surface on a wall in each channel opposite the partition with the ramped surface widening each channel as it extends from the entrance opening to the exit opening and an electrically conductive terminal embedded in the partition which has tangs extending into each at an angle inclined toward the exit opening of each channel. A pair of wedges are provided for insertion into the exit end of each channel. After an electric wire is inserted into each channel through the entrance end by a sufficient distance into the channel until the wire at least overlays the tangs of the terminal, a wedge is forced into the exit end of each channel to force the inserted electric wire down onto the tangs of the terminal to make electrical contact with the terminal and to force the electric wire into locked engagement between the partition and the inserted wedge in each channel.

The Fox Patent discloses an insulation pierce-type connector for a ribbon cable. It comprises a base and a mating cover joined together to clamp a multi-conductor flat flexible cable. The cover and base have aligned cavities for accommodating contact elements which are inserted through the top of the cover after the cable is clamped. The elements have insulation piercing slots so that each element slices through the conductor insulation to electrically engage a conductor wire and are shaped so as to hold the base and cover in engagement after contact is achieved with conductor wires.

The Weidler Patent discloses a connector for terminating small gauge magnet wires. It comprises a terminal which is a one-piece metal strip. The strip has a bowed wire engaging portion with a convex, serrated, wire engaging surface and mounting arms extending in the direction of the bow from opposite ends.

The Sowinski Patent discloses a connector fabrication method and apparatus for voiding selected terminals from a connector assembly wherein an array of terminals, joined to a common carrier member, are partially preloaded in a connector housing. The apparatus includes a punch having a first projection which engages and deforms the terminal. The punch further includes a second projection following the first projection, for severing the terminal from the carrier strip. The selected terminals are disengaged and extracted from the connector housing and severed from the carrier member, at the voiding station.

The Cruise Patent discloses an electrical connector with a preloaded spring-like terminal with an improved wiping action. The electrical connector includes a dielectric body mounting a flexible leaf-type terminal which has a spring contact portion for surface engagement with a contact element of a mating connector component.

The Kwiat Patent discloses an electrical connector assembly for facilitating the establishment of an electrical connection with a terminal on an electrical component when the component and the connector assembly are brought toward each other.

The Arnett Patent discloses an insulation displacement connector for facilitating an electrical contact with an insulated wire conductor. The connector has a wire passage to receive an insulated wire conductor, and capturing a contact member which has an electrically conductive hook portion in the housing. An end of the hook portion projects into the wire passage. When an insulated wire conductor is fed into the passage, insulation on the conductor slides along the hook portion of the contact member. Upon withdrawing or displacing the conductor a certain distance relative to the hook portion, an end of the hook portion engages and pierces the insulation on the conductor to make electrical contact with the conductor.

It is highly desirable to have a very efficient and also very effective design and construction of a connector assembly having means for penetrating the insulation and establishing electrical connection with the insulated electrical wires, thereby eliminating the need to strip the insulation from the insulated wires. It is desirable to provide a connector assembly with the capability of rapidly establishing an electrical connection without the need to strip the insulation away from the insulated wires.

SUMMARY OF THE INVENTION

The present invention is a connector assembly having means for penetrating the insulation and establishing electrical connection with insulated electrical wires or conductors, thereby eliminating the need to strip the insulation away from the insulated wires.

The connector assembly comprises a pair of matable housings, a pair of conductor guides, a pair of flexible piercing terminals and a pair of rotatable cams or levers, and which are all enclosed by the pair of matable housings. The unstriped insulated wires are respectively inserted into and positioned within the pair of conductor guides, where the cams are rotated inwardly such that the cams engage and squeeze the conductor guides to retain the insulated wires thereto. While the cams are being rotated, they also engage the piercing terminals such that knife ends pierce the insulated wires or conductors to establish electrical connection thereto.

It is therefore an object of the present invention to provide a connector assembly for use in terminating insulated electrical wires or conductors and which can be applied to the insulated wires without special tools.

It is also an object of the present invention to provide a connector assembly which includes flexible piercing terminals for penetrating the insulation and establishing electrical connection with electrical wires or conductors, thereby eliminating the need to strip the insulation away from the insulated wires prior to establishing the electrical connection.

It is an additional object of the present invention to provide a connector assembly which includes adaptable wire guides, so that a plurality of different sized diameter insulated wires or conductors may be used with the connector assembly.

It is a further object of the present invention to provide a connector assembly which includes rotatable cams or levers, where the cams are rotated to engage and squeeze conductor guides to retain the insulated conductors thereto and the cams are further engaged with the piercing terminals to make an electrical connection with conductors thereto.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
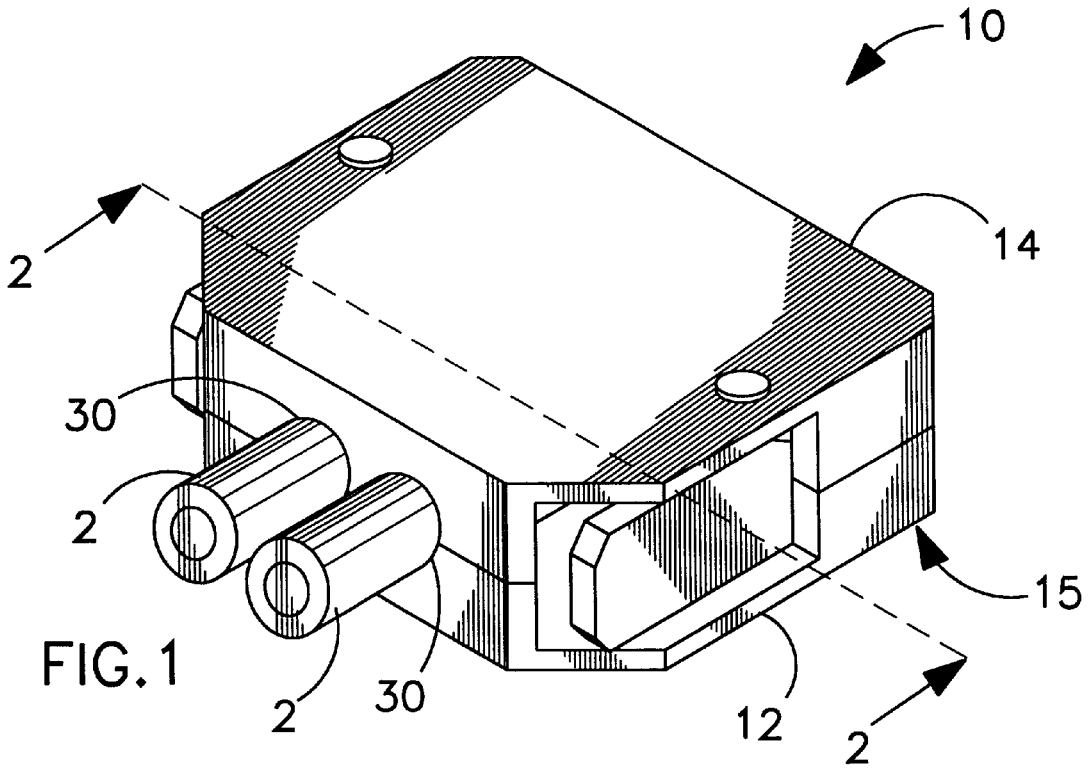
FIG. 1 is a perspective view of the present invention connector assembly fully assembled, with insulated electrical conductors installed thereto.
Figure 2:
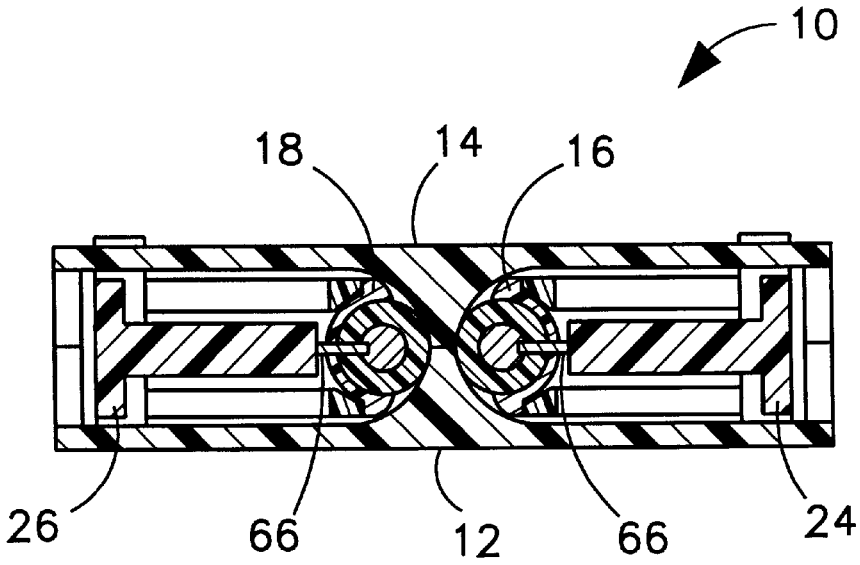
FIG. 2 is a cross-sectional view taken along line 2—2 of FIG. 1.

Referring to FIG. 1, there is shown at 10 a perspective view of the present invention connector assembly fully assembled, with insulated conductors or wires 2 installed thereto. The connector assembly 10 has means for penetrating the insulation and quickly facilitating and establishing electrical connection with insulated conductors 2.

Figure 3:
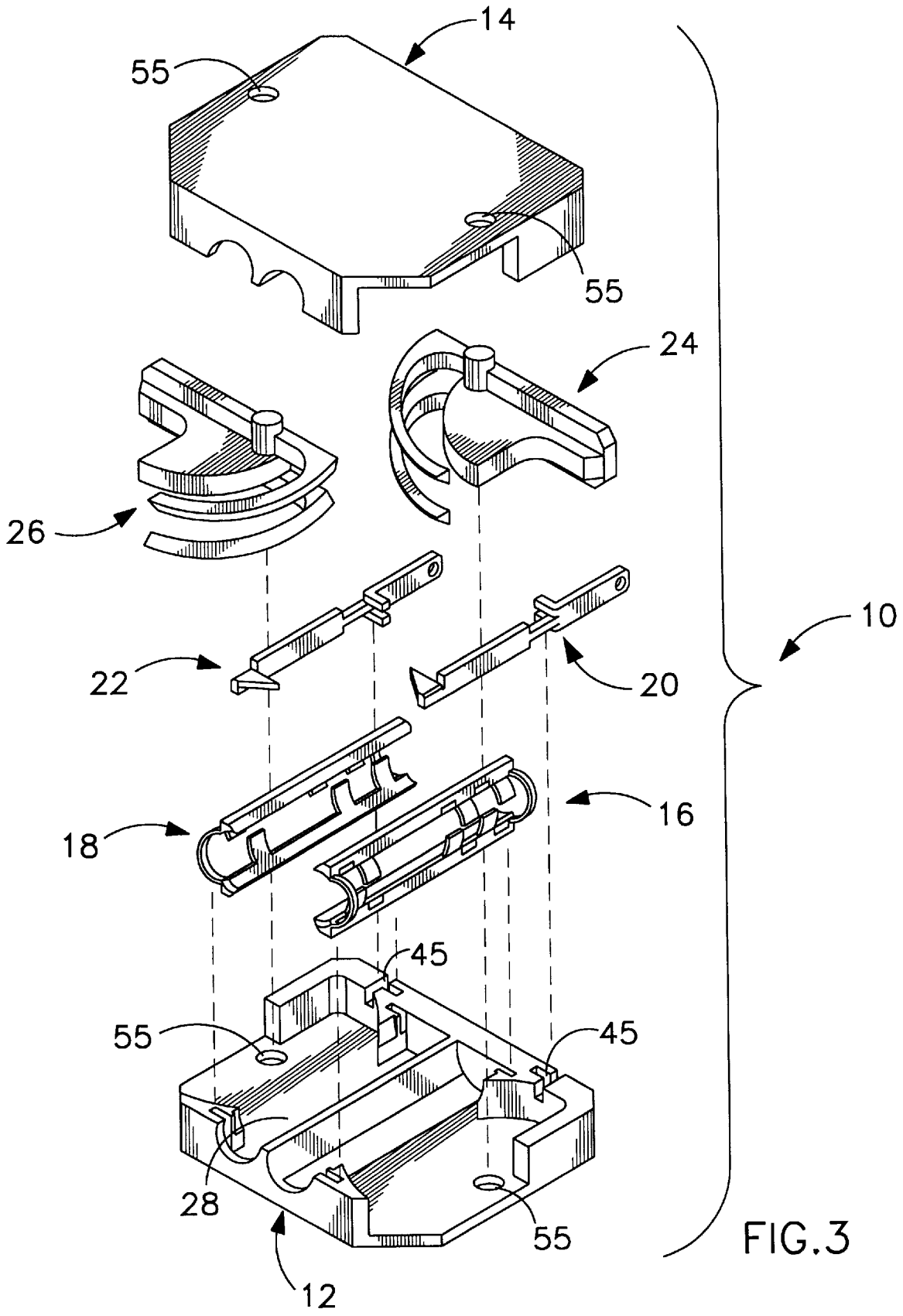
FIG. 3 is an exploded perspective view of the present invention connector assembly.
Figure 4:
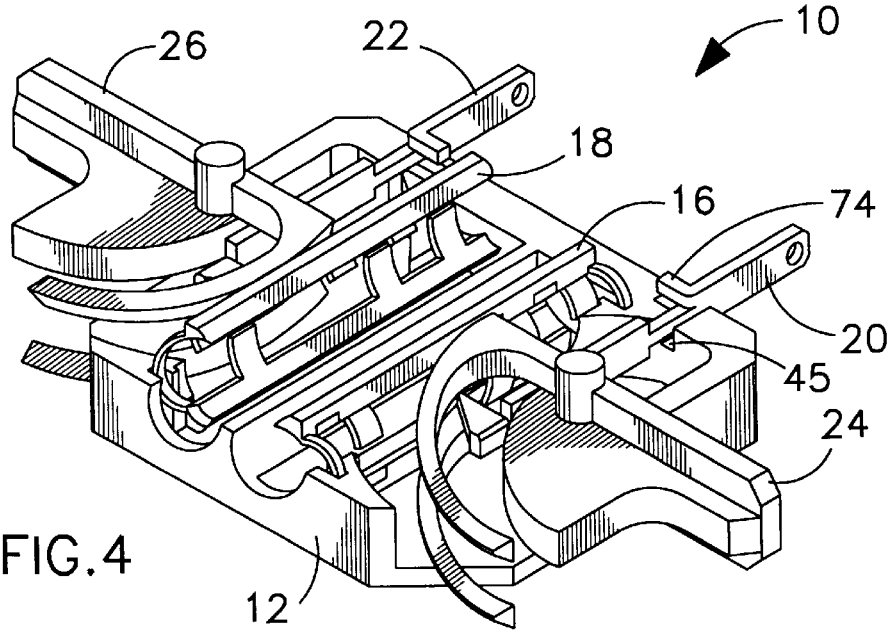
FIG. 4 is a perspective view of the present invention connector assembly, showing various components of the connector assembly, without one of the two housings and without the conductors installed thereto.

FIG. 3 shows an exploded perspective view of the present invention connector assembly 10. FIG. 4 shows a perspective view of the present invention connector assembly 10 in the unterminated position or condition, before the insulated conductors 2 are installed and pierced. Referring to FIGS. 3 through 10, the connector assembly 10 comprises a first half housing or shell 12, a complementary second half housing or shell 14, a pair of adaptable conductor guides 16 and 18, a pair of flexible piercing terminals 20 and 22, and a pair of rotatable cams or levers 24 and 26.

Each housing has a conformed interior compartment 28 which includes a conductor guide location, a piercing terminal location and a cam location. The two housings 12 and 14 are interconnected together to form a main housing 15 for respectively retaining and securing the conductor guides 16 and 18, the piercing terminals 20 and 22, and the rotatable cams 24 and 26 to the guide locations, the piercing terminal locations and the cam locations of the two half housings 12 and 14. When formed, the main housing 15 has at least two spaced apart apertures 30 (see FIG. 1) located in the longitudinal direction for allowing the insulated conductors 2 to be inserted thereto and two pairs of spaced apart apertures 55 located in the transverse direction. The housings 12 and 14 are constructed of electrically non-conductive material.

For ease of understanding, only the components on the left side of the connector assembly 10 will be described in detail since it should be understood that the components on the right side of the connector assembly 10 are a substantially identical mirror image, and to the extent they are, only the components on the left side of the connector assembly 10 will be described in detail.

Referring to FIGS. 3 through 8, the conductor guide 16 has a semi-cylindrical body 32 which includes two opposite ridges 34 extending along the longitudinal direction of the conductor guide 16, two opposite arch shaped ends 38 integrally connected to the two opposite ridges 34, and a plurality of flanges or fingers 36 which extend in the transverse direction of the semi-cylindrical body 32. The conductor guide 16 is positioned and secured between the interior compartments 28 of the first and second housings 12 and 14, where the conductor guide 16 forms a conductor passage which is aligned with one of the at least two spaced apart apertures 30 of the main housing 15 for retaining a plurality of different sized diameter conductors of the insulated conductors 2.

Referring to FIGS. 3, 4, 5, 6, 7, and 9, the piercing terminal 20 is constructed of electrically conductive material and has an elongated thin flat body 21 which includes a flexible portion 64 with a knife shaped or piercing end 66, a semi-rigid portion 68 with a connection end and a narrow middle portion 72 interconnecting the flexible portion 64 with the semi-rigid portion 68. There are also provided a pair of flanges 74 on opposite sides of the middle portion 72 and located between the middle portion 72 and the semi-rigid portion 68 for reinforcing the semi-rigid portion 64 from being bent. The connection end 70 may have an aperture 76 for providing connection means to the electronic devices, electrical speaker wires, etc. The piercing terminal 20 is positioned and secured between the interior compartments 28 of the first and second housings 12 and 14, such that the flanges 74 are positioned within recesses 45 provided by the first and second housings 12 and 14, and the connection end 70 extends out from the main housing 15 while the knife shaped end 66 is located adjacent to the conductor guide 16.

Referring to FIG. 3, 4, 5, 6, 7 and 10, the rotatable cam 24 includes a straight or handle portion 48 and a pair of spaced apart arch shaped arms 50 integrally connected to one end of the straight portion 48. There is provided an arch shaped engagement portion 52 which is integrally formed with the interior side 46 of the straight portion 48. There are also provided two transverse protruding bosses 54 (only one is shown) located on opposite sides of the straight portion 48 of the rotatable cam 24. The rotatable cam 24 is positioned and secured between the interior compartments 28 of the first and second housings 12 and 14, such that the two protruding bosses 54 are inserted into the apertures 55 provided by the first and second housings 12 and 14. In the unterminated position or condition, the handle portion 48 extends out from the main housing 15 while the pair of arch shaped arms 50 are partially within the main housing 15.

Figure 5:
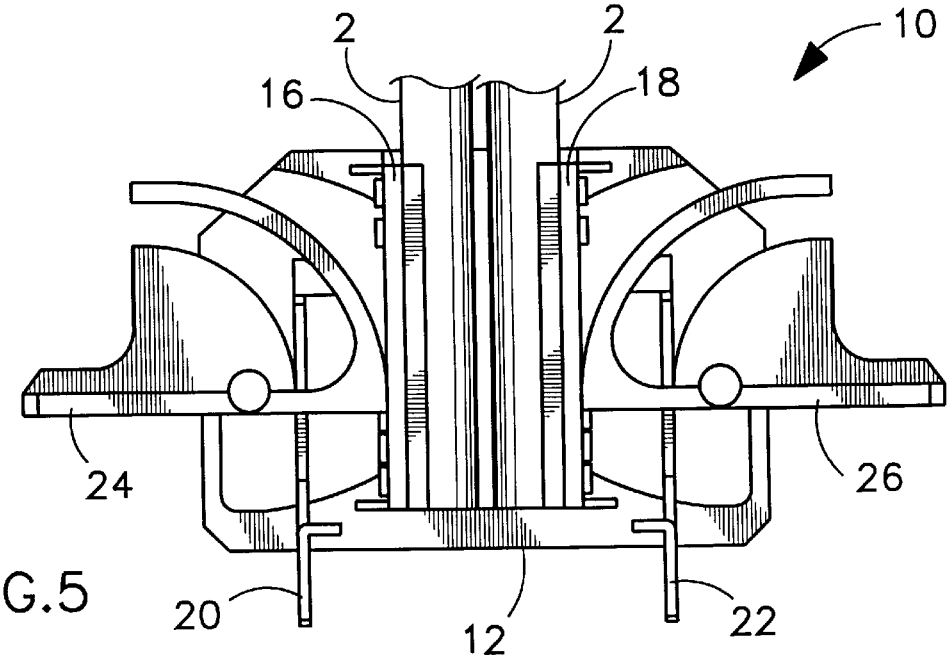
FIG. 5 is a plan view showing the unterminated position of the present invention connector assembly without one of the two housings and the conductors installed thereto.
Figure 6:
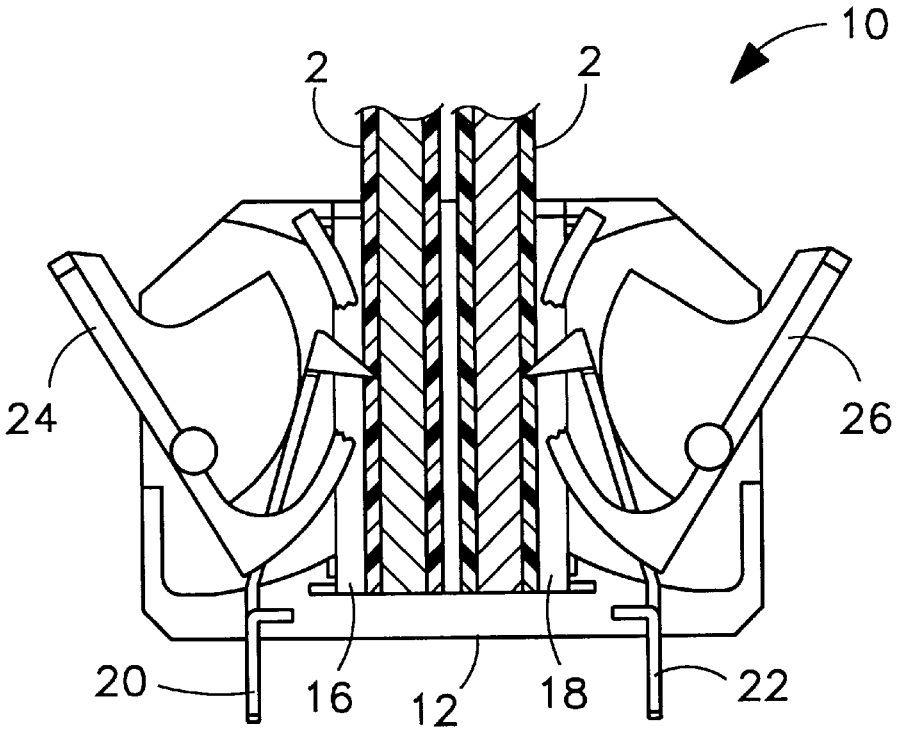
FIG. 6 is a plan view of the present invention connector assembly, showing the flexible piercing terminals piercing the insulation of the insulated conductors.
Figure 7:
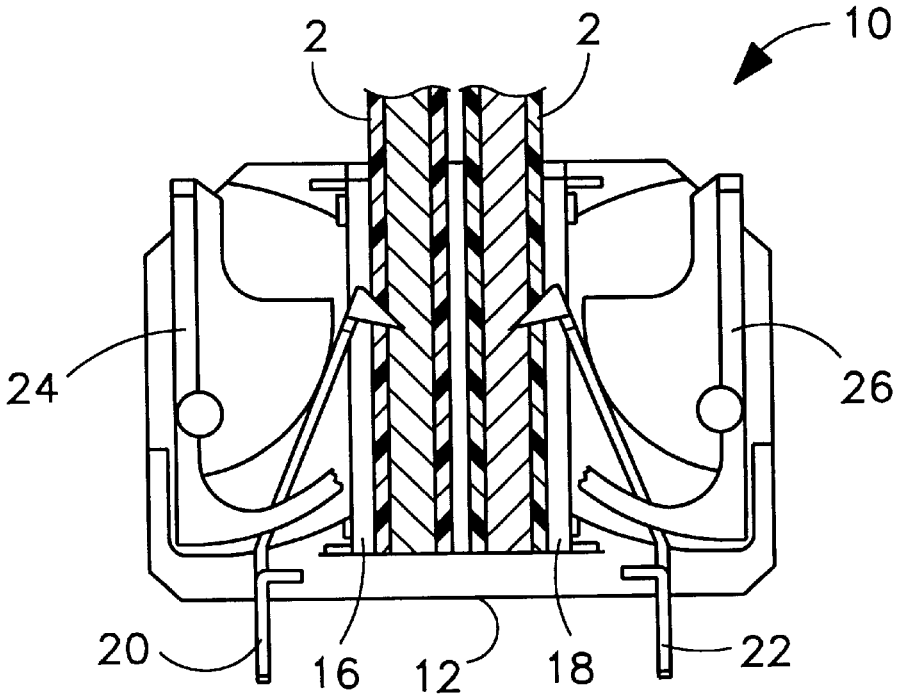
FIG. 7 is a plan view showing the terminated position of the present invention connector assembly, where the flexible piecing terminals establish electrical connection with the insulated conductors.
Figure 8:
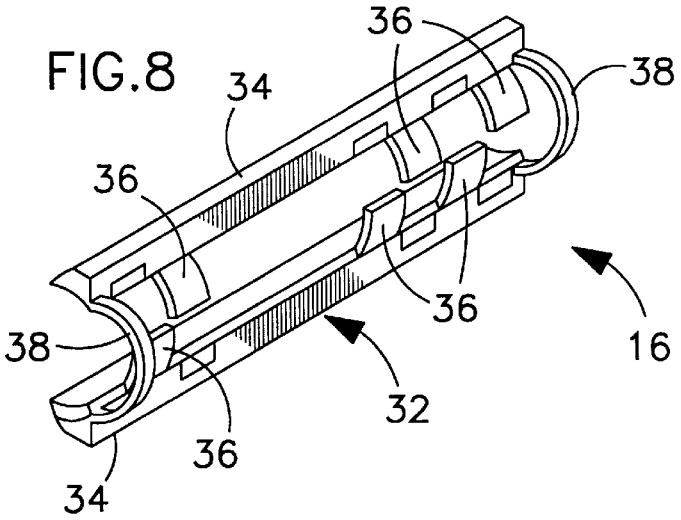
FIG. 8 is an enlarged perspective of one of the two adaptable conductor guides of the present invention connector assembly.
Figure 9:
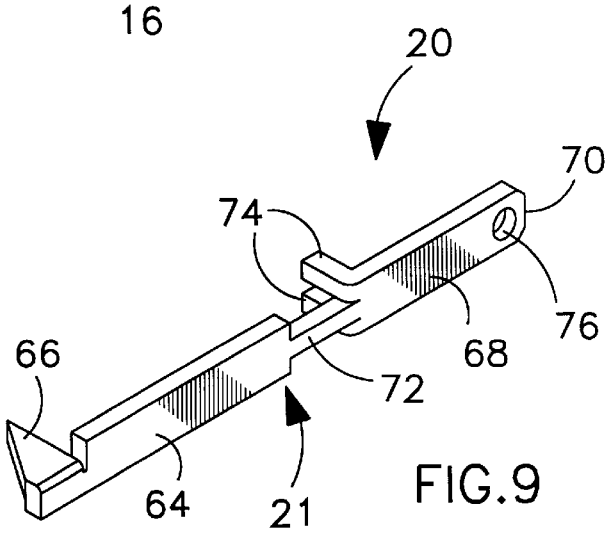
FIG. 9 is an enlarged perspective of one of the two rotatable cams of the present invention connector assembly.
Figure 10:
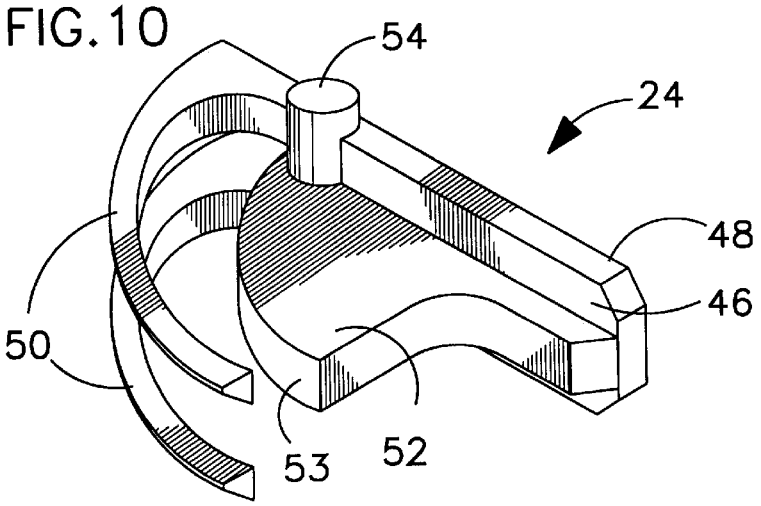
FIG. 10 is an enlarged perspective of one of the two flexible piecing terminals of the present invention connector assembly.

FIG. 5 shows the present invention connector assembly 10 in its unterminated position or condition, before the insulated conductors 2 are pierced. FIG. 6 shows the present invention connector assembly 10, where the knife shaped ends 66 of flexible piercing terminals 20 and 22 pierce the insulation of the insulated conductors 2. FIG. 7 shows the present invention connector assembly 10 in its terminated position or condition, where the knife shaped ends 66 of the flexible piecing terminals establish electrical connection with the insulated conductors 2. Referring to FIGS. 1 through 10, the unstriped conductors 2 are respectively inserted into the apertures 30 provided by the main housing 15 and positioned within the conductor guides 16 and 18. The handle portions 48 of the rotatable cams 24 and 26 are rotated inwardly such that the arch shaped arms 50 engage and push the ridges 34 of the conductor guides 16 and 18 together to squeeze and secure the conductors 2 thereto (see FIG. 2). While the rotatable cams 24 and 26 are being rotated, engagement surfaces 53 of the engagement portions 52 engage and push the flexible portions 64 of the piercing terminals 20 and 22 inwardly such that the knife shaped ends 66 pierce the insulated electrical wires or conductors 2 to establish electrical connection thereto.

The present invention has many advantageous features including: (a) the user does not have to strip the insulation away from the conductors prior to establishing an electrical connection; and (b) the conductor guides will automatically accept conductors between 10 gauge wires through 20 gauge wires without special adapters or adjustment by the user.

The benefit of present invention is easy installation which carries over from custom install in-wall speakers and ceiling speakers to standard floor-standing speakers as well as consumer electronics.

The present invention conforms to conventional forms of manufacture or any other conventional way known to one skilled in the art.

Defined in detail, the present invention is a connector assembly for quickly facilitating and establishing electrical connection with a pair of insulated conductors, the connector assembly comprising: (a) a first half housing having an interior compartment; (b) a complementary second half housing having an interior compartment which is a mirror image of the interior compartment of the first half housing and matable with the first half housing to form a main housing with a pair of spaced apart apertures; (c) a pair of adaptable conductor guides positioned and secured within the interior compartments of the first and second housings and forming conductor passages aligned with the pair of apertures of the main housing for retaining a plurality of different sized diameter conductors of the pair of insulated conductors; (d) a pair of flexible piercing terminals positioned and secured within the interior compartments of the first and second housings, the pair of piercing terminals respectively located adjacent to the pair of adaptable conductor guides, each piercing terminal having a knife shaped end located adjacent to the each adaptable conductor guide and a connection end extending out from the main housing; and (e) a pair of rotatable cams rotatably positioned and secured within the interior compartments of the first and second housings, each rotatable cam having a pair of spaced apart arch shaped arms located adjacent to the each conductor guide, an engagement portion located adjacent to the each piercing terminal and a handle portion for rotating the each rotatable cam; (f) whereby rotating the pair of rotatable cams causes the pair of arch shaped arms of the each rotatable cam to engage and squeeze the each conductor guide to retain the each insulated conductor thereto, and the engagement portion of the each rotatable cam engages and pushes the each piercing terminal such that the knife end of the each piercing terminal pierces the insulation of the each insulated conductor to establish the electrical connection thereto.

Defined broadly, the present invention is a connector assembly for quickly facilitating and establishing electrical connection with at least two insulated conductors, the connector assembly comprising: (a) a first half housing; (b) a complementary second half housing matable with the first half housing to form a main housing with at least two spaced apart apertures; (c) at least two conductor guides positioned and secured between the first and second housings and forming conductor passages aligned with the at least two apertures of the main housing for retaining a plurality of different sized diameter conductors of the at least two insulated conductors; (d) at least two piercing terminals positioned and secured between the first and second housings, and respectively located adjacent to the at least two conductor guides, each piercing terminal having a knife shaped end located adjacent to the each adaptable conductor guide; and (e) at least two cams rotatably positioned and secured between the first and second housings, each cam having a pair of arch shaped arms located adjacent to the each conductor guide and an engagement portion located adjacent to the each piercing terminal; (f) whereby rotating the at least two cams causes the pair of arch shaped arms of the each cam to engage and squeeze the each conductor guide to retain the each insulated conductor thereto, and the engagement portion of the each cam engages and pushes the each piercing terminal such that the knife end of the each piercing terminal pierces the insulation of the each insulated conductor to establish the electrical connection thereto.

Defined more broadly, the present invention is a connector assembly for quickly facilitating and establishing electrical connection with at least one insulated conductor, the connector assembly comprising: (a) a first half housing; (b) a second half housing matable with the first half housing to form a main housing with at least one aperture; (c) at least one conductor guide positioned and secured between the first and second housings and forming a conductor passage aligned with the at least one aperture of the main housing for retaining a plurality of different sized diameter conductors of the at least one insulated conductor; (d) at least one piercing terminal positioned and secured between the first and second housings, and located adjacent to the at least one conductor guide, the at least one piercing terminal having means for penetrating the insulation of the at least one insulated conductor and establishing electrical connection; and (e) at least one cam rotatably positioned and secured between the first and second housings and having first means located adjacent to the at least one conductor guide and second means located adjacent to the at least one piercing terminal; (f) whereby rotating the at least one cam causes the first means of the at least one cam to engage and squeeze the at least one conductor guide to retain the at least one insulated conductor thereto, and the second means of the at least one cam engages and pushes the at least one piercing terminal such that the penetrating means of the at least one piercing terminal pierces the insulation of the at least one insulated conductor to establish the electrical connection thereto.

Defined even more broadly, the present invention is a connector for quickly facilitating and establishing electrical connection with at least one insulated conductor, the connector comprising: (a) a shell having at least one aperture; (b) at least one conductor guide positioned and secured within the shell and forming a conductor passage aligned with the at least one aperture of the shell for positioning and retaining the at least one insulated conductor thereto; (c) at least one piercing terminal positioned and secured within the shell and having means for penetrating the insulation of the at least one insulated conductor and establishing electrical connection; and (d) at least one cam rotatably positioned and secured within the shell and having means for engaging with the at least one piercing terminal to pierce the insulation of the at least one insulated conductor and establishing electrical connection thereto; (e) whereby rotating the at least one cam causes the engaging means of the at least one cam to engage and squeeze the at least one conductor guide to retain and secure the at least one insulated conductor thereto, and the engaging means of the at least one cam further engages with the at least one piercing terminal to establish the electrical connection with the at least one insulated conductor.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A connector assembly for quickly facilitating and establishing electrical connection with a pair of insulated conductors, the connector assembly comprising:

a. a first half housing having an interior compartment;

b. a complementary second half housing having an interior compartment which is a mirror image of said interior compartment of said first half housing and matable with said first half housing to form a main housing with a pair of spaced apart apertures;

c. a pair of adaptable conductor guides positioned and secured within said interior compartments of said first and second housings and forming conductor passages aligned with said pair of apertures of said main housing for retaining a plurality of different sized diameter conductors of said pair of insulated conductors;

d. a pair of flexible piercing terminals positioned and secured within said interior compartments of said first and second housings, the pair of piercing terminals respectively located adjacent to said pair of adaptable conductor guides, each piercing terminal having a knife shaped end located adjacent to said each adaptable conductor guide and a connection end extending out from said main housing; and e. a pair of rotatable cams rotatably positioned and secured within said interior compartments of said first and second housings, each rotatable cam having a pair of spaced apart arch shaped arms located adjacent to said each conductor guide, an engagement portion located adjacent to said each piercing terminal and a handle portion for rotating said each rotatable cam;

f. whereby rotating said pair of rotatable cams causes said pair of arch shaped arms of said each rotatable cam to engage and squeeze said each conductor guide to retain said each insulated conductor thereto, and said engagement portion of said each rotatable cam engages and pushes said each piercing terminal such that said knife end of said each piercing terminal pierces the insulation of said each insulated conductor to establish the electrical connection thereto.

2. The connector assembly in accordance with claim 1, wherein said plurality of different sized diameter conductors include ten gauge conductor through twenty gauge conductor.

3. A connector assembly for quickly facilitating and establishing electrical connection with at least two insulated conductors, the connector assembly comprising:

a. a first half housing;

b. a complementary second half housing matable with said first half housing to form a main housing with at least two spaced apart apertures;

c. at least two conductor guides positioned and secured between said first and second housings and forming conductor passages aligned with said at least two apertures of said main housing for retaining a plurality of different sized diameter conductors of said at least two insulated conductors;

d. at least two piercing terminals positioned and secured between said first and second housings, and respectively located adjacent to said at least two conductor guides, each piercing terminal having a knife shaped end located adjacent to said each adaptable conductor guide; and e. at least two cams rotatably positioned and secured between said first and second housings, each cam having a pair of arch shaped arms located adjacent to said each conductor guide and an engagement portion located adjacent to said each piercing terminal;

f. whereby rotating said at least two cams causes said pair of arch shaped arms of said each cam to engage and squeeze said each conductor guide to retain said each insulated conductor thereto, and said engagement portion of said each cam engages and pushes said each piercing terminal such that said knife end of said each piercing terminal pierces the insulation of said each insulated conductor to establish the electrical connection thereto.

4. The connector assembly in accordance with claim 3, wherein said plurality of different sized diameter conductors include ten gauge conductor through twenty gauge conductor.

5. The connector assembly in accordance with claim 3, wherein said each piercing terminal further includes a connection end extending out from said main housing for connecting to electronic devices.

6. The connector assembly in accordance with claim 3, wherein said each cam further includes a handle portion for rotating said each cam.

7. A connector assembly for quickly facilitating and establishing electrical connection with at least one insulated conductor, the connector assembly comprising:

a. a first half housing;

b. a second half housing matable with said first half housing to form a main housing with at least one aperture;

c. at least one conductor guide positioned and secured between said first and second housings and forming a conductor passage aligned with said at least one aperture of said main housing for retaining a plurality of different sized diameter conductors of said at least one insulated conductor;

d. at least one piercing terminal positioned and secured between said first and second housings, and located adjacent to said at least one conductor guide, the at least one piercing terminal having means for penetrating the insulation of said at least one insulated conductor and establishing electrical connection; and e. at least one cam rotatably positioned and secured between said first and second housings and having first means located adjacent to said at least one conductor guide and second means located adjacent to said at least one piercing terminal;

f. whereby rotating said at least one cam causes said first means of said at least one cam to engage and squeeze said at least one conductor guide to retain said at least one insulated conductor thereto, and said second means of said at least one cam engages and pushes said at least one piercing terminal such that said penetrating means of said at least one piercing terminal pierces the insulation of said at least one insulated conductor to establish the electrical connection thereto.

8. The connector assembly in accordance with claim 7, wherein said plurality of different sized diameter conductors include ten gauge conductor through twenty gauge conductor.

9. The connector assembly in accordance with claim 8, wherein said at least one cam further includes a handle portion for rotating said at least one cam.

10. The connector assembly in accordance with claim 7, wherein said penetrating means of said at least one piercing terminal includes a knife piercing end.

11. The connector assembly in accordance with claim 7, wherein said at least one piercing terminal further includes a connection end extending out from said main housing for connecting to electronic devices.

12. The connector assembly in accordance with claim 7, wherein said at least one cam further includes a handle portion for rotating said at least one cam.

13. The connector assembly in accordance with claim 7, wherein said first means of said at least one cam includes a pair of spaced apart arch shaped arms.

14. The connector assembly in accordance with claim 7, wherein said second means of said at least one cam includes an engagement portion.

15. A connector for quickly facilitating and establishing electrical connection with at least one insulated conductor, the connector comprising:

a. a shell having at least one aperture;

b. at least one conductor guide positioned and secured within said shell and forming a conductor passage aligned with said at least one aperture of said shell for positioning and retaining said at least one insulated conductor thereto;

c. at least one piercing terminal positioned and secured within said shell and having means for penetrating the insulation of said at least one insulated conductor and establishing electrical connection; and d. at least one cam rotatably positioned and secured within said shell and having means for engaging with said at least one piercing terminal to pierce the insulation of said at least one insulated conductor and establishing electrical connection thereto;

e. whereby rotating said at least one cam causes said engaging means of said at least one cam to engage and squeeze said at least one conductor guide to retain and secure said at least one insulated conductor thereto, and said engaging means of said at least one cam further engages with said at least one piercing terminal to establish the electrical connection with the at least one insulated conductor.

16. The connector in accordance with claim 15, wherein said at least one conductor guide having adaptable means for retaining a plurality of different sized diameter conductors of said at least one insulated conductor.

17. The connector in accordance with claim 15, wherein said at least one piercing terminal further includes a connection end extending out from said shell for connecting to electronic devices.

18. The connector in accordance with claim 15, wherein said penetrating means of said at least one piercing terminal includes a knife piercing end.

19. The connector in accordance with claim 15, wherein said engaging means of said at least one cam includes a pair of spaced apart arch shaped arms and an engagement portion.

20. The connector in accordance with claim 15, wherein said at least one cam further includes a handle portion for rotating said at least one cam.

* * * * *